US007165496B2

(12) United States Patent
Reynolds

(10) Patent No.: US 7,165,496 B2
(45) Date of Patent: Jan. 23, 2007

(54) PISTON HEAD CARTRIDGE FOR A FIREARM

(76) Inventor: S. Paul Reynolds, 2966 Knox Hwy. 3, Altona, IL (US) 61414

( * ) Notice: Subject to any disclaimer, the term of this patent is extended or adjusted under 35 U.S.C. 154(b) by 245 days.

(21) Appl. No.: 10/844,191

(22) Filed: May 12, 2004

(65) Prior Publication Data

US 2005/0115445 A1 Jun. 2, 2005

Related U.S. Application Data

(60) Provisional application No. 60/517,769, filed on Nov. 6, 2003.

(51) Int. Cl.
*F42B 5/26* (2006.01)

(52) U.S. Cl. ..... 102/469

(58) Field of Classification Search ..... 102/469, 102/430, 444, 446, 447
See application file for complete search history.

(56) References Cited

U.S. PATENT DOCUMENTS

| | | | | |
|---|---|---|---|---|
| 27,933 | A | 4/1860 | Smith et al. | |
| 62,283 | A | 1/1867 | Millbank | |
| 102,675 | A | 5/1870 | Gatling | |
| 121,808 | A | 12/1871 | Payne | |
| 125,640 | A | 4/1872 | Wesson | |
| 172,716 | A | 1/1876 | Dimock | |
| 268,601 | A | 12/1882 | Bailey | |
| 592,942 | A | 11/1897 | Tichenor | |
| 692,154 | A | 1/1902 | Lammadin et al. | |
| 933,030 | A | 8/1909 | Funk | |
| 1,082,975 | A | 12/1913 | Rylands | |
| 1,345,565 | A | 7/1920 | Thompson | |
| 1,461,013 | A | 3/1923 | Hodge | |
| 1,491,000 | A | 4/1924 | Brandt et al. | |
| 2,379,056 | A | 6/1945 | Alexander | |
| 2,522,208 | A | 9/1950 | Catlin | |
| 2,793,455 | A | 5/1957 | Wignall | |
| 2,922,341 | A * | 1/1960 | Treat, Jr. | 89/7 |
| 3,050,894 | A | 8/1962 | Ivy | |
| 3,359,903 | A | 12/1967 | Sobolewski | |
| 3,477,374 | A | 11/1969 | Barr | |
| 3,609,904 | A | 10/1971 | Scanlon | |
| 3,613,584 | A | 10/1971 | Hnedricks | |
| 3,786,761 | A | 1/1974 | Ciccone et al. | |
| 3,855,900 | A | 12/1974 | Barr et al. | |
| 3,911,821 | A | 10/1975 | Finot et al. | |
| 4,085,677 | A | 4/1978 | Marcinkiewicz | |
| 4,132,173 | A | 1/1979 | Amuchastegut | |
| 4,236,451 | A * | 12/1980 | Galluzzi | 102/351 |
| 4,316,341 | A | 2/1982 | Landry | |

(Continued)

FOREIGN PATENT DOCUMENTS

| | | |
|---|---|---|
| AU | 403856 A1 | 10/1969 |

(Continued)

*Primary Examiner*—Michael Carone
*Assistant Examiner*—John Amir Radi
(74) *Attorney, Agent, or Firm*—Krieg DeVault LLP

(57) ABSTRACT

A firearm cartridge is provided with a case body and a piston head. The piston head is movably engaged with a rearward end of the case body. The piston head seals the rearward end of the case body to contain propellant gases in the case body when the firearm cartridge is fired.

39 Claims, 11 Drawing Sheets

U.S. PATENT DOCUMENTS

| | | | | | |
|---|---|---|---|---|---|
| 4,353,304 | A | | 10/1982 | Hubsch et al. | |
| 4,356,769 | A | * | 11/1982 | Galluzzi | 102/380 |
| 4,424,638 | A | | 1/1984 | Hillberg | |
| 4,537,134 | A | * | 8/1985 | Galluzzi | 102/380 |
| 4,615,133 | A | | 10/1986 | Center | |
| 4,848,237 | A | | 7/1989 | Zedrosser | |
| 4,955,157 | A | | 9/1990 | Brighton et al. | |
| 5,157,219 | A | | 10/1992 | Calsson et al. | |
| 5,359,937 | A | * | 11/1994 | Dittrich | 102/430 |
| 5,481,978 | A | | 1/1996 | Muller et al. | |
| 5,490,463 | A | | 2/1996 | Lamberty et al. | |
| 5,492,063 | A | * | 2/1996 | Dittrich | 102/430 |
| 5,677,505 | A | * | 10/1997 | Dittrich | 89/14.5 |
| 5,834,681 | A | * | 11/1998 | DuBay | 102/430 |
| 6,095,051 | A | * | 8/2000 | Saxby | 102/444 |
| 6,178,889 | B1 | * | 1/2001 | Dindl | 102/447 |
| 6,324,983 | B1 | * | 12/2001 | Dindl | 102/447 |
| 6,324,984 | B1 | * | 12/2001 | Dindl | 102/447 |
| 6,367,389 | B1 | | 4/2002 | Westrom et al. | |
| 6,415,718 | B1 | * | 7/2002 | Saxby | 102/446 |
| 6,422,149 | B1 | * | 7/2002 | Saxby | 102/446 |
| 6,427,600 | B1 | * | 8/2002 | Saxby | 102/444 |
| 6,439,123 | B1 | * | 8/2002 | Dionne et al. | 102/430 |
| 6,516,725 | B1 | | 2/2003 | Jackson et al. | |
| 6,564,719 | B1 | * | 5/2003 | Saxby | 102/446 |
| 6,575,098 | B1 | * | 6/2003 | Hsiung | 102/498 |
| 2002/0189486 | A1 | | 12/2002 | Westrom et al. | |

FOREIGN PATENT DOCUMENTS

| | | |
|---|---|---|
| DE | 004408774 | 3/1994 |
| WO | WO 01/46637 A2 | 6/2001 |

* cited by examiner

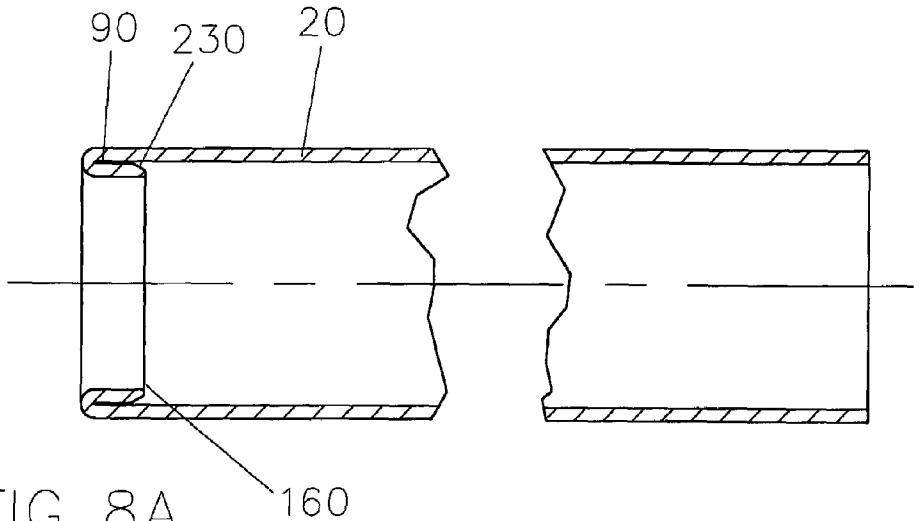
FIG 8A
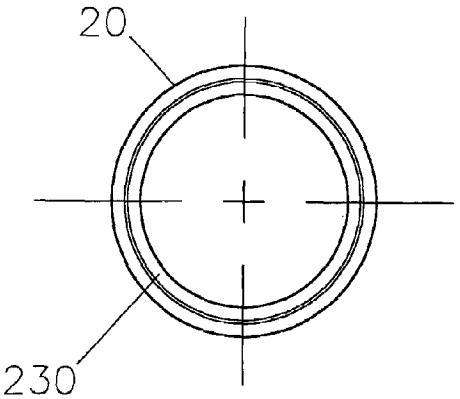
FIG 8B
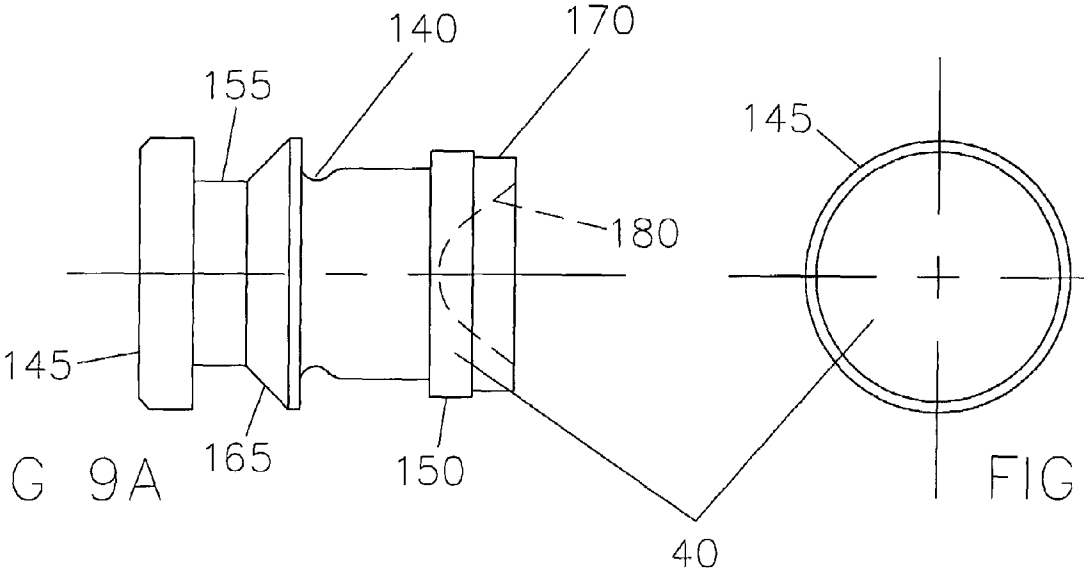
FIG 9A
FIG 9B

PISTON HEAD CARTRIDGE FOR A FIREARM

CROSS-REFERENCE TO RELATED APPLICATION

This application claims the benefit of the filing date of U.S. Provisional Application Ser. No. 60/517,769 filed on Nov. 6, 2003.

BACKGROUND

A gun, like an automobile engine or gas turbine, is a heat engine. The function of a gun as a heat engine is to convert the chemical energy of the propellant into kinetic energy in the projectile. As with any other heat engine, the efficiency of the thermodynamic process in a gun determines how much propellant is required to deliver the required kinetic energy to the projectile. Since the efficiency of a thermodynamic process is measured by the temperature drop across the process (exclusive of losses), then the greater the temperature drop, the greater the efficiency and the smaller the amount of propellant required to launch a projectile at a given muzzle velocity. Temperature drop across the process corresponds directly to pressure drop. Therefore, the greater the pressure drop, the greater the thermodynamic efficiency, resulting in less propellant being required to perform a given amount of work. Small arms firearms have been designed to operate at higher and higher pressures as discoveries and inventions permit to achieve greater efficiencies.

Major enhancements in the performance of small arms internal ballistics have been stalled since the end of the nineteenth century indirectly due to the persistent use of conventional Boxer and Berdan primers. Conventional primers, which are cheap, small, reliable and effective, are well matched for use in the conventional pressure (60,000 psi) cartridges and firearms for which they were designed. However, the design of conventional cartridges has prevented the harnessing of a large percentage of the potential energy contained in propellants. The placement of the primer in the base of conventional cartridge cases locates the primer behind the chamber of the barrel during firing. The cartridge case itself must therefore provide its own radial support in containment of the firing pressure inside the primer pocket.

The use of conventional primers located in the bases of conventional cartridges results in firearms operating at relatively low pressures as compared to the high pressure (230,000 psi) and high efficiency which conventional propellants are capable of delivering. Accordingly, the situation has developed, and has been taken for granted, that large quantities of propellant contained in large "bottle necked" cartridge cases are required to provide currently accepted external ballistics. These large bottle necked cartridge cases have dictated the limits on the kinds and sizes of mechanisms which can be employed in self powered firearms. For example, military bottle necked cartridges with their large diameter bases place very high loads on locking mechanisms because of the large pressure area of the head of the cartridge case. Conventional firearm locking mechanisms must be designed to be much more robust than if their cartridges could be designed with small head diameters.

In self-powered firearms, some of the energy generated by firing is stored in the operating mechanism in the form of kinetic energy, which is subsequently used to power the firearm cycle of functioning. The pressurized gas generated in firing is an excellent power source, but the energy release occurs in a few milliseconds, and then subsides before the energy is needed to perform the work of cycling the firearm.

Several basic methods have been employed for storing functioning energy in conventional firearm operating systems. The most widely employed operating system type used in high powered, light-weight military small arms is gas operation. In typical gas operating systems, a small quantity of propellant gas is directed from the barrel bore into a gas cylinder through a gas port connecting the barrel bore with the gas cylinder. The pressurized gas can be trapped in a variety of piston and cylinder arrangements, and the energy of the trapped gas is then used to accelerate (impart kinetic energy to) the firearm operating mechanism parts. The breech of a gas operated system remains locked and sealed during, and for a short time after, firing. The potential energy (in the pressurized gas) that has been transferred to the gas system is converted into kinetic energy in the operating system primary mass. The primary mass is usually called the operating rod or bolt carrier.

The secondary mass (the bolt) remains locked and stationary while the barrel and cartridge case are pressurized during the time the projectile remains in the bore. After the projectile exits the muzzle and the pressure in the barrel substantially subsides, and after the primary mass moves a short distance (referred to as "dwell"), then the bolt is unlocked through interaction of the bolt carrier (primary mass) with the bolt. After dwell some energy is expended in unlocking, and considerable energy is expended in momentum transfer in picking up the bolt and causing the bolt to move rearward with the primary mass. If the primary/secondary mass ratio is 5/1 the energy loss is 16.8%. If the primary/secondary mass ratio is 4/1, the energy loss is 20%.

Gun designers exercise care in establishing the ratio between the primary and secondary masses. On the one hand, a high primary/secondary mass ratio is desirable in order to reduce the velocity of the bolt carrier impacting and picking up the bolt because the direct impact of highly loaded parts tends to damage parts. On the other hand, a high primary/secondary mass ratio is undesirable because it increases firearm size and weight. Usually the bolt (secondary mass) is designed to be as light as possible while still being able to reliably perform its work. After determining the required bolt weight, the primary mass parts are ordinarily designed with enough mass to provide the minimum acceptable primary/secondary mass ratio while considering the required cyclic rate, and acceptable recoiling mass velocities.

Operating systems which employ a primary/secondary mass are typically costly to manufacture depending upon the number, complexity, fit and material of the parts employed. Moreover, a typical gas operating system requires expensive precision fits and alignment between the gas piston and gas cylinder. A further costly aspect in the production of gas operated systems concerns headspace. Practically speaking headspace is the distance from the face of the fully locked bolt to the rear of a fully seated cartridge. Headspace must be limited to a few thousandths of an inch for a conventional firearm to function reliably and safely. The locking lugs of the bolt, along with their supporting recesses in the receiver, and the chamber, must all precisely fit with each other; i.e. provide proper headspace, to insure the conventional cartridge will be properly positioned and supported during firing. Conventional cartridges used with locked systems must also be precisely manufactured to fit the headspace length of the firearm in order to prevent chambering stoppages if the cartridge is too long; or to prevent case head separations during firing if the cartridge is too short.

A typical locked breech gas operated powering system includes multiple parts and assemblies. Most gas operating system parts, such as gas cylinders, gas pistons, bolt carriers, bolt cam pins, bolts, barrel extensions and receivers must be fabricated to close tolerances. Some parts, such as cams, require complex and expensive machining. Certain features of these parts also require high finishes and close fits with tight tolerances, and must maintain dimensional stability through the heat treatment process. Parts warpage in heat treatment causes many quality assurance problems.

Recoil operation is another type of locked firearm operating system widely used in small arms. Recoil operated systems, like gas operated systems, employ primary/secondary masses with many of the same design considerations as gas operated systems. Recoil operated systems are inherently the least ballistically accurate of the operating systems because the barrel recoils within the receiver, and all the firing parts move relative to the sights.

Retarded blowback operating systems are not locked, but employ primary/secondary masses or toggle arrangements with design considerations similar to those of gas and recoil operating systems. Retarded blowback operating systems are sensitive to mounting conditions and to ammunition variations.

Delayed blowback operating systems remain locked until chamber pressure drops somewhat before the bolt is unlocked and blown back by residual chamber pressure. Delayed blowback operating systems are difficult to design because of the very close timing requirements for unlocking, and their extreme sensitivity to ammunition variations.

Piston primer operation is another type of operating system (see U.S. Pat. No. 3,855,900 to Barr et al.) in which a special piston primer is used. The piston primer functions as the primer, as part of the operating system, and as a sliding seal with the rear of the cartridge to prevent leakage of pressurized propellant gas. The piston primer is driven rearwardly (while maintaining the seal) by the pressurized gas created upon firing. The rear of the piston primer drives rearward the firing pin, which is a part of the primary mass. Piston primer operation, though it eliminates a gas system in the firearm, still requires the same basic primary/secondary mass relationship as required with gas, recoil and retarded blowback operation. All the functions of locking, firing, unlocking, extraction, ejection, and powering are concentrated in and competing to occupy a very small space at the front of the bolt.

Blowback (straight blowback) operation is the simplest of the self-operating firearm systems. Blowback operation is very successfully employed with many low pressure cartridges, especially .22 caliber rimfire cartridges and virtually all sub-machineguns employing pistol cartridges. In blowback operation, there is only a primary mass, the bolt. The bolt does not lock the cartridge into the chamber for firing. Rather, the projectile is accelerated through the barrel by the full force of the propellant gas pressure at the same time the bolt is accelerated rearwardly by the full force of the propellant gas pressure. Only the inertia of the mass of the bolt is required to prevent the bolt from opening too quickly. The restraining effect on the bolt by the operating spring is negligible. Conventional blowback operation is highly desirable for its simplicity and low cost of manufacture. However, blowback operation has been heretofore limited to use with low pressure cartridges in which the entire cartridge case can slip rearward relative to the chamber while the pressure is still being applied to accelerate the projectile through the bore.

The head of a conventional cartridge case, regardless of the firearm operating system employed, acts as the plug for the chamber of the barrel. The cartridge case wall adjoining the cartridge case head seals this plug through expansion of the cartridge case wall against the chamber of the barrel. Since the primer of conventional cartridges is located outside the rear of the barrel breech, firearm operating pressures have been limited by the strength of the case head material surrounding the primer pocket, regardless of the operating system employed and robustness of the firearm.

One problem in employing simple blowback operation in a firearm firing conventional high pressure bottle-neck cartridges is that the pressure in the cartridge case drives the head of the cartridge case and bolt much farther than the cartridge case can stretch while the cartridge case wall is seized in the chamber. In this situation, the cartridge case head will be ripped from the cartridge case body when the firearm is fired, causing the cartridge to rupture.

BRIEF DESCRIPTION OF THE DRAWINGS

FIGS. 8A and 8B are a sectional side view of the cartridge case body and a right end view of the cartridge case body of FIG. 8A, respectively.

FIGS. 9A and 9B are a side view of the piston head and a left end view of the piston head of FIG. 9A, respectively.

DETAILED DESCRIPTION OF THE ILLUSTRATED EMBODIMENTS

Figures 1, 2:
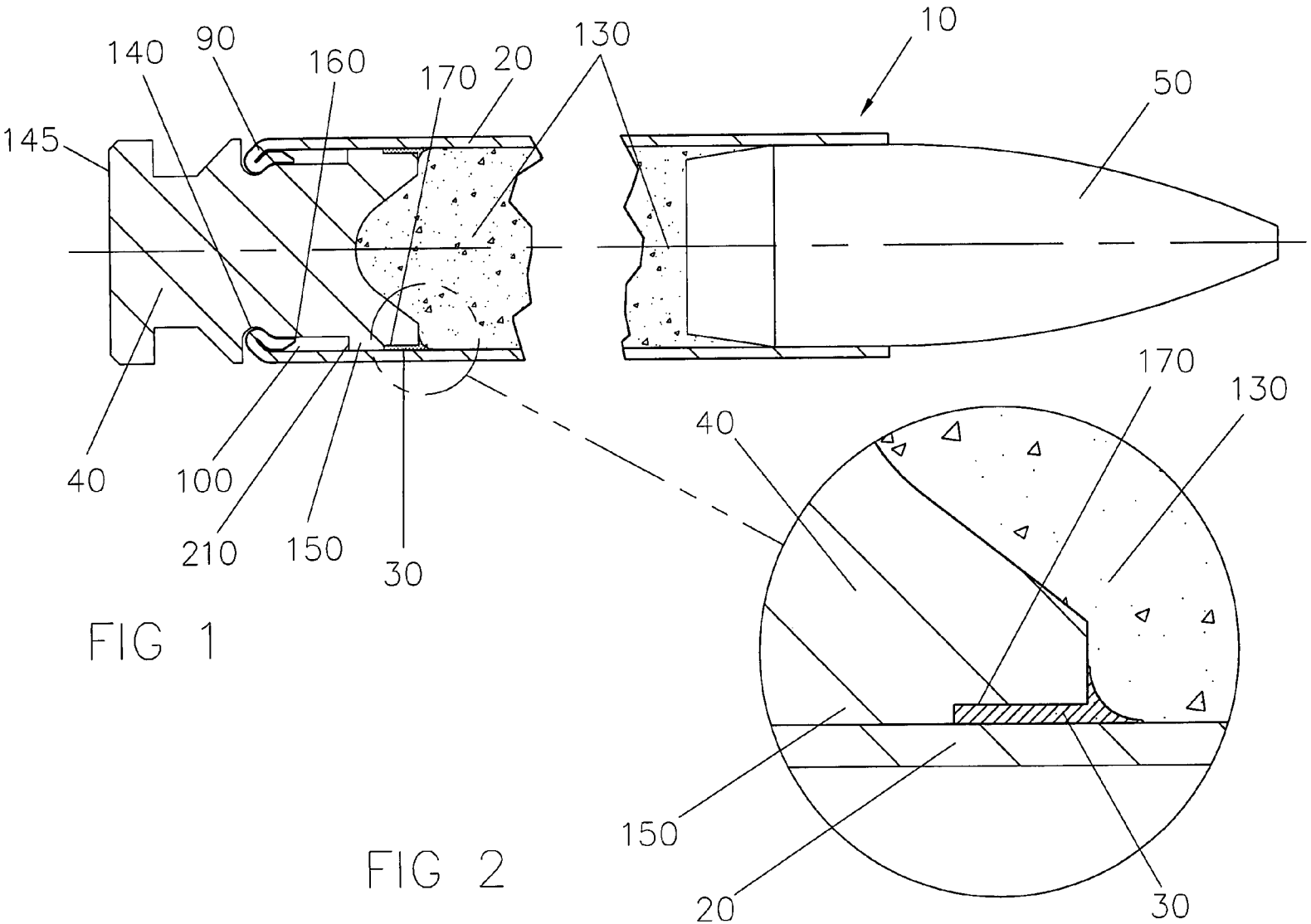
FIG. 1 is a side view of a piston head cartridge in partial section.
FIG. 2 is an enlarged view of the primer area of the cartridge of FIG. 1.

For the purposes of promoting an understanding of the principles of the invention, reference will now be made to the embodiments illustrated in the drawings and specific language will be used to describe the same. It will nevertheless be understood that no limitation of the scope of the invention is thereby intended. Any such alterations and further modifications in the illustrated device, and any such further applications of the principles of the invention as illustrated therein being contemplated as would normally occur to one skilled in the art to which the invention relates.

Referring now to FIG. 1, there is shown a piston head firearm cartridge 10 which includes a cartridge case body 20, a piston head 40, a projectile 50, a priming composition 30 and a propellant 130. Projectile 50 is secured to the forward end of cartridge case body 20 with any suitable securement arrangement. Cartridge case body 20 defines a hollow interior for receiving propellant 130 between projectile 50 and piston head 40. Piston head 40 is secured to a rearward end of cartridge case body 20 by a rearward portion 90 of cartridge case body 20. The longitudinal axes of piston head 40 and cartridge case body 20 are coincident with one another. Rearward portion 90 is received into an intermediate groove 140 of piston head 40 to prevent relative movement between cartridge case body 20 and piston head 40 until firing. Intermediate groove 140 can be sealed with a sealing material.

As further shown in FIG. 2, piston head 40 is provided with a forward flange 150 projecting radially thereabout, and from which a forward groove 170 extends forwardly to a forward end of piston head 40. As shown in FIG. 1 a rearward flange 145 extends about a grooved area 155, facilitating engagement of rearward flange 145 by an extractor. In FIG. 1, an intermediate flange 165 is positioned between grooved area 155 and intermediate groove 140, and projects radially outwardly into alignment with the outer surface of cartridge case body 20. In FIG. 2 forward flange 150 is closely fitted to the interior wall of cartridge case body 20. In one form, forward flange 150 provides an interference fit with the interior wall of cartridge case body 20. In FIG. 1 rearward portion 90 of cartridge case body 20 is positioned in groove 140 of piston head 40, providing a gap 100 between a forward end shoulder 160 of rearward portion 90 and a rearward shoulder 210 of forward flange 150 of piston head 40. Gap 100 extends between the outer surface of piston head 40 and the inner wall surface of cartridge case body 20.

In FIG. 1 forward groove 170 forms a forwardly opening recess between the inner wall surface of cartridge case body 20 and piston head 40. After rearward portion 90 has been formed, crimped, bent, or otherwise positioned into intermediate groove 140 of piston head 40 to fixedly engage cartridge case body 20 with piston head 40, priming composition 30 is placed in the priming recess formed by forward groove 170 in a wet condition. FIGS. 1 and 2 show priming composition 30 filling forward groove 170. When priming composition 30 is dried, it will be in molecular contact with piston head 40 and cartridge case body 20 In FIG. 1 after priming composition 30 has dried, propellant 130 is loaded into the hollow interior of case body 20, and projectile 50 is seated to assemble the cartridge case.

Figure 3:
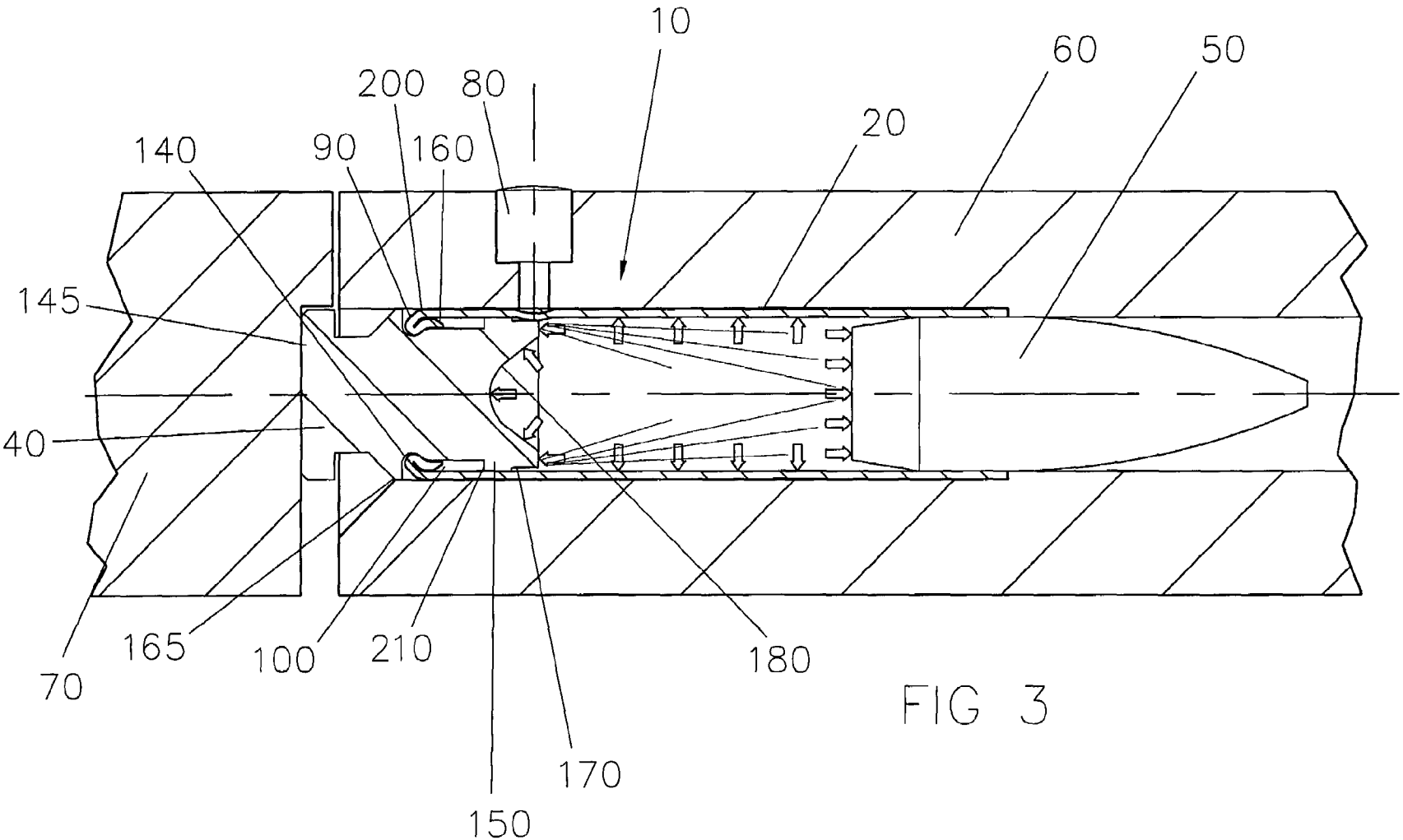
FIG. 3 is a side view in partial section of the cartridge of FIG. 1 in a blowback operated firearm chamber and in the act of firing, with the projectile and bolt having only microscopically moved.

Referring now to FIG. 3, there is shown piston head cartridge 10 chambered in a barrel 60 of a blowback operated firearm. A bolt 70 is located rearwardly of barrel 60 and along the rearward end of piston head 40. The firearm is in the act of firing; however, piston head 40 and projectile 50 have only microscopically begun to move. A firing pin 80 has been struck by a mechanism not shown to deform the wall of cartridge case body 20. The priming composition has been initiated by being crushed between cartridge case body 20 and the outer surface of piston head 40 extending about forward groove 170 of piston head 40. Once initiated, the priming composition ignited the propellant, which has now combusted. Cartridge case body 20 thus provided a striking member about priming the composition now deflagrated, and the forward groove 170 of piston head 40 acted as an anvil against which the priming composition was sharply crushed for ignition. The striking member and forward groove 170 of piston head 40 are forwardly positioned of the rearward end of cartridge case body 20, and confined between the walls of the barrel chamber housing cartridge case body 20.

As the propellant pressure increases, the wall of cartridge case body 20 expands radially against the inside of the chamber of barrel 60 seizing cartridge case body 20 within the chamber of barrel 60. The propellant pressure will drive projectile 50 forward by overcoming bullet inertia, bullet pull and other shot start resistances. Piston head 40 is provided with recess 180, which includes a concave curvature or other suitable shape to permit the propellant gas to generate a radial component to the forces applied by the propellant gases to recess 180. The radial forces applied to recess 180 press forward flange 150 sufficiently against the inside of cartridge case body 20 to form a pressure actuated sliding seal between the now stationary cartridge case body 20 and moving piston head 40. Other sealing means could be employed.

Figure 4:
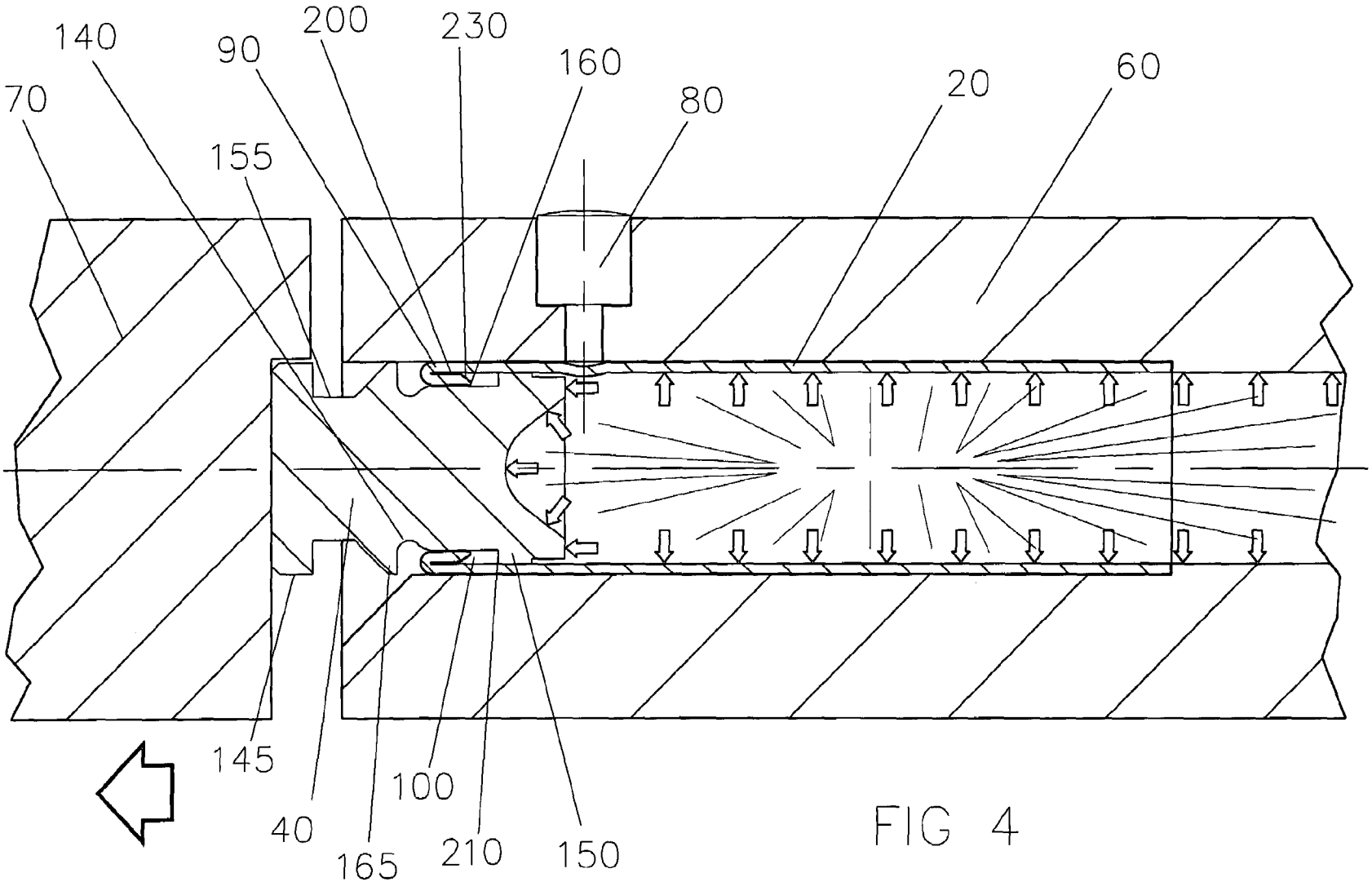
FIG. 4 is a sectional side view of the cartridge case in the blowback operated firearm of FIG. 3 in the act of firing with the piston head and bolt beginning to move, with the cartridge case body remaining seized and stationary within the chamber.

Referring now to FIG. 4, piston head 40 and bolt 70 have begun to move perceptibly rearwardly, as indicated by the arrow below bolt 70. The projectile, not shown, which has moved forward in the barrel, is being accelerated through the bore. Cartridge case body 20 remains seized against and stationary with the chamber of barrel 60 because the pressure of the propellant gases far exceeds the elastic strength of cartridge case body 20. Cartridge case body 20 is completely radially supported by barrel 60. Firing pin 80 is supported by a means not shown.

Piston head 40, in moving rearwardly, has forced rearward portion 90 of cartridge case body 20 out of intermediate groove 140, unfixing piston head 40 from cartridge case body 20. Rearward portion 90 has been plastically deformed, such that it is no longer deflected into intermediate groove 140, but rather is forced to conform to the shape of gap 100 along piston head 40. In one form, rearward portion 90 is a fold in which an inner wall member extends along an outer wall member, forming a fold space 200 therebetween. If any gas leakage has occurred through the seal formed between forward flange 150 and the wall of cartridge case body 20, then the escaped gas will be directed by a chamfer 230 into fold space 200. The escaped gas forces the inner wall member of rearward portion 90 away from cartridge case body 20, and into contact with the outer surface of piston head 40. This forms a secondary or back-up seal against escape of gas to the rear. Chamfer 230 results in forward end shoulder 160 being narrowed, which conveniently provides a plastically deformable buffer to attenuate the shock of piston head 40 impacting cartridge case body 20 at forward end shoulder 160 as piston head 40 moves rearwardly.

Figure 5:
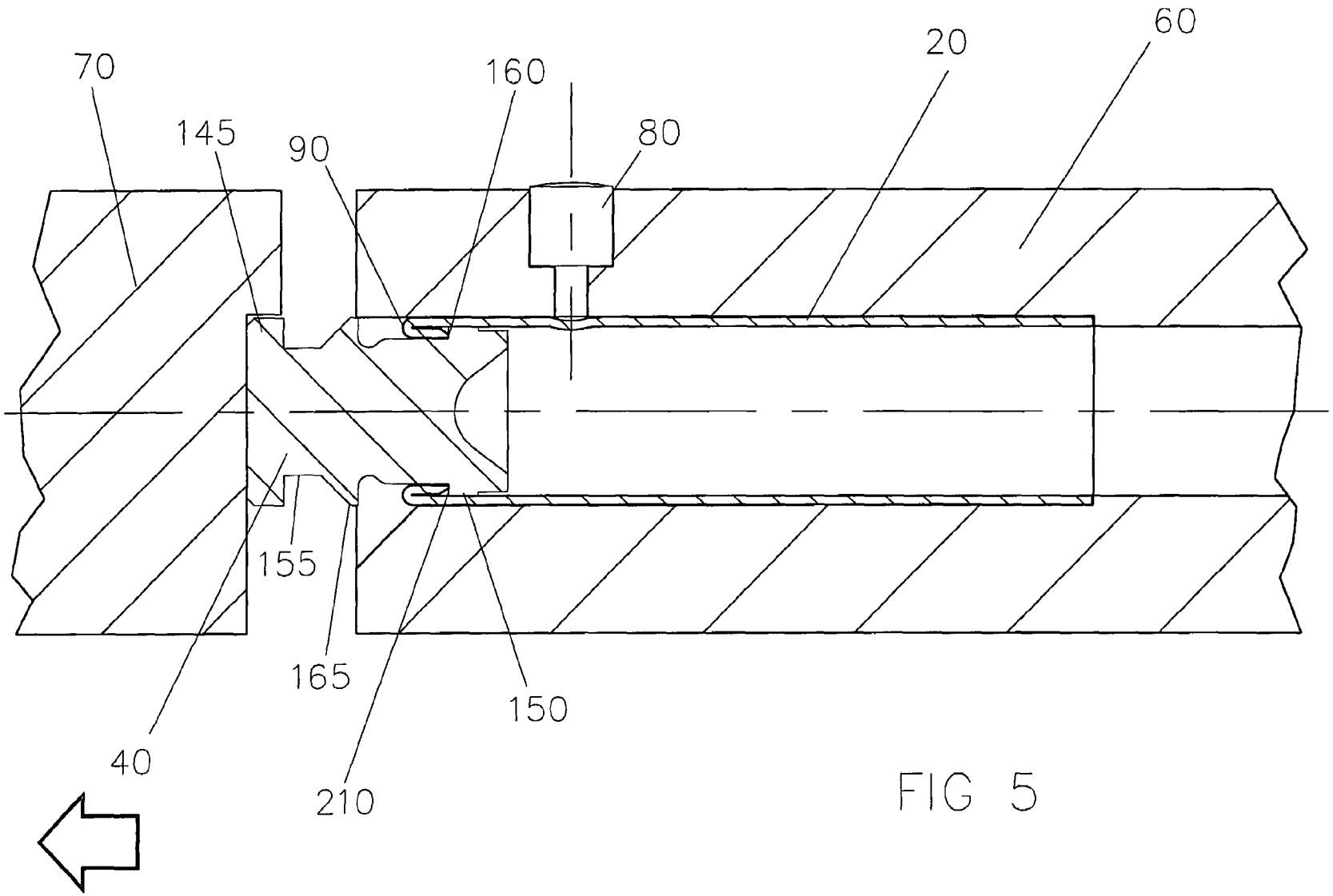
FIG. 5 is a sectional side view of the cartridge case and firearm of FIG. 4 with the bolt and piston head of the cartridge in a further stage of recoil and after the projectile has left the barrel.

Referring now to FIG. 5, piston head 40 and bolt 70 continue to move rearwardly in recoil as represented by the arrow under bolt 70. The projectile, not shown, has left the barrel, and the pressure in the barrel has subsided below the elastic strength of cartridge case body 20, and cartridge case body 20 is no longer seized against the chamber wall of barrel 60. Cartridge case body 20 has elastically contracted so that cartridge case body 20 is free of the wall of the chamber of barrel 60. Cartridge case body 20 has not yet begun to move even though it is free to move. Piston head 40 has moved sufficiently rearwardly so rearward shoulder 210 contacts forward end shoulder 160, and gap 100, of FIG. 4, is closed.

Figure 6:
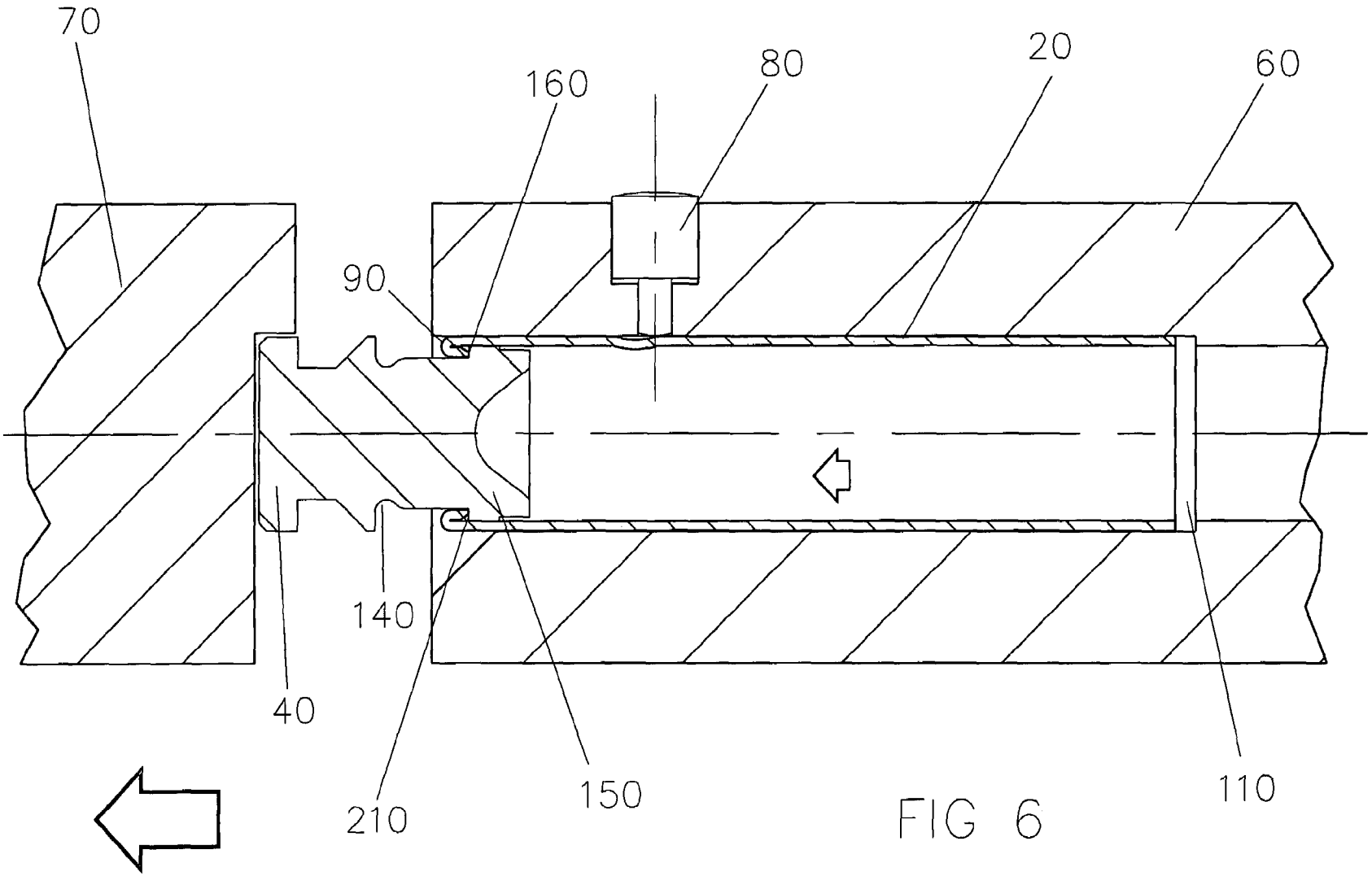
FIG. 6 is a sectional side view of the cartridge case and firearm of FIG. 5 with the bolt continuing to recoil after cartridge case body picks up. The cartridge case body has just begun moving with the bolt and the piston head of the cartridge case.

Referring now to FIG. 6, piston head 40 and bolt 70 continue in recoil as represented by the arrow under bolt 70, with bolt 70 being propelled rearwardly by its own inertia. An extractor, not shown, connects bolt 70 with piston head 40. Rearward shoulder 210 of forward flange 150 of piston head 40 has impacted forward end shoulder 160 of cartridge case body 20. Upon impact, forward end shoulder 160 of cartridge case 20 and rearward shoulder 210 of forward flange 150 of piston head 40 may be slightly plastically deformed as a result of the impact. This possible plastic deformation conveniently serves to attenuate the shock of piston head 40 impacting cartridge case body 20, and in picking up and accelerating cartridge case body 20. Cartridge case body 20 has begun to be moved rearwardly as represented by the small arrow inside the cartridge case in FIG. 6. A space 110 is opened at the forward end of cartridge case body 20 as piston head 40 and cartridge case body 20 move rearwardly.

During extraction of the cartridge case body 20, the mechanism for retaining firing pin 80 in place against cartridge case body 20 is released. This permits firing pin 80 to move out of the depression in cartridge case body 20 formed by the firing pin tip during firing.

Figure 7:
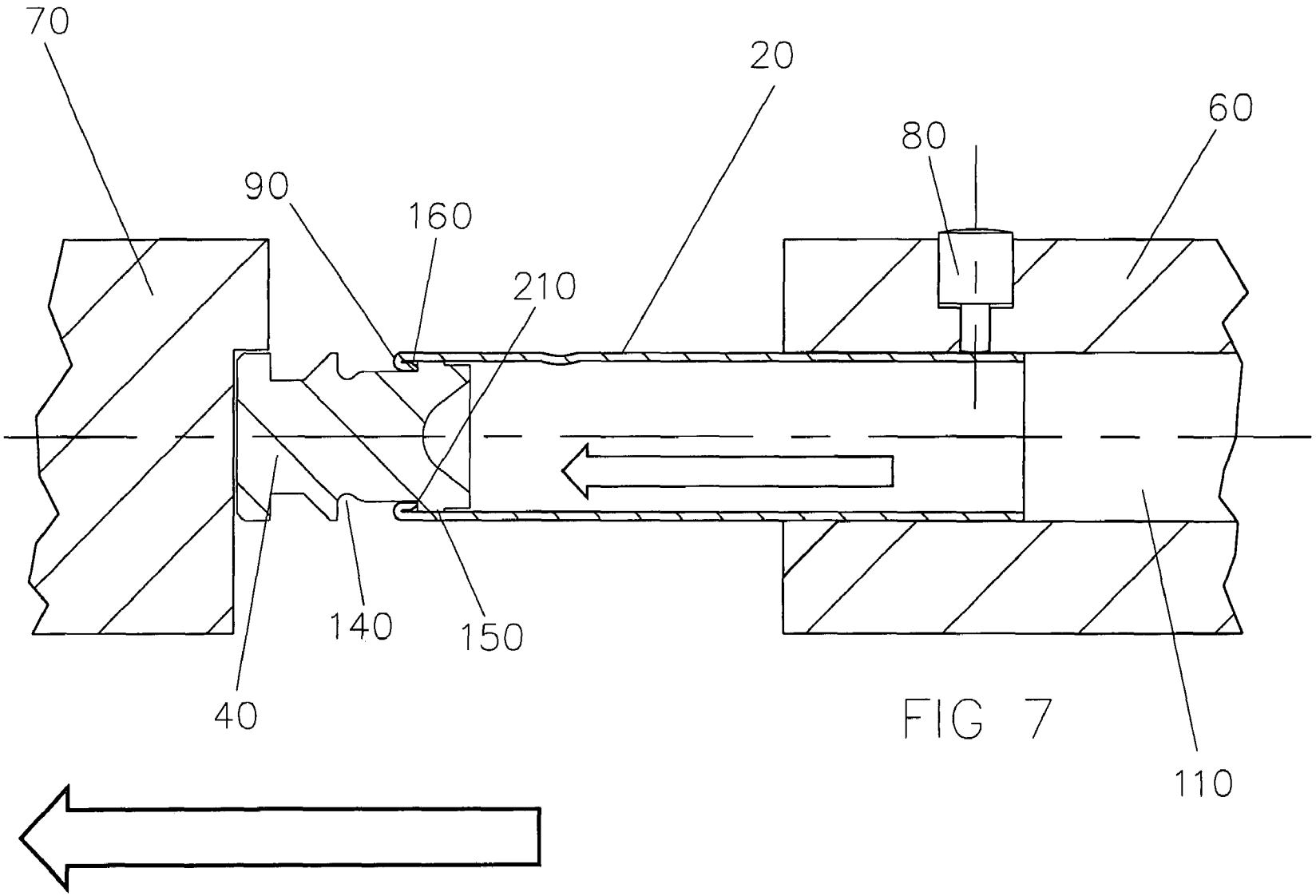
FIG. 7 is a sectional side view of the cartridge case and firearm of FIG. 6 with the bolt continuing in recoil with extraction nearing completion.

Referring now to FIG. 7, bolt 70 continues to move rearwardly in recoil of its own inertia. Bolt 70 is provided with an extractor, not shown, which carries with it piston head 40 and cartridge case body 20. Space 110 continues to open as extraction continues.

Referring now to FIGS. 8A and 8B, there is shown cartridge case body 20 in isolation. Rearward portion 90 is shown before it is crimped into intermediate groove 140 of piston head 40, not shown, but shown in FIG. 9A. It can be seen that cartridge case body 20 is a simple component, which can be formed from malleable tubing with no wastage of material. Chamfer 230 is also illustrated, extending along forward end shoulder 160 and tapering rearwardly.

Referring now to FIGS. 9A and 9B, there is shown piston head 40 in isolation. Piston head 40 can be fabricated from a single piece of material, and is of a form suitable for inexpensive production in large quantities on automatic screw machines. Other suitable manufacturing techniques are also contemplated.

The cartridge case body of the firearm cartridges disclosed herein can be formed from sheared extruded tubing with no wastage of stock material. Conventional brass cartridge cases are made from blanks coined from sheets of cartridge brass. This can leave a great deal of wastage to be recycled. The piston head of the cartridges disclosed herein can be manufactured on automatic screw machines which are capable of quickly producing very large quantities of parts. No special tooling, such as the deep draw dies used in the manufacture of conventional cartridge cases, is required.

For many years there have been attempts made to develop cartridge cases deep drawn from aluminum because aluminum is lighter in weight and less expensive than brass. A severe problem which has continued to plague the use of aluminum in high pressure cartridge cases is related to the burn-through of aluminum cartridge cases, which can result from a severe scratch on the outside of the case. When a burn-through occurs in an aluminum case, the aluminum around the burn-through opening becomes fuel for the escaping fire, causing the hole to rapidly grow larger permitting even more burning gas to escape. This ignites even more aluminum with the final result that a large quantity of hot gas is released at the breech. This burning gas produces a large and destructive flash, which is very dangerous to the shooter and damaging to the firearm.

Aluminum is a viable choice for fabrication of the piston head portion of the firearm cartridges disclosed herein, however, because the piston head does not have a thin section where, if scratched, could result in a burn-through. Even if a burn-through path were intentionally made as a test in the front of the piston head before assembly with the cartridge case body, the crimped fold portion at the rear of the cartridge case body would serve as a secondary seal to prevent further escape of gas.

Although not considered necessary, the use of steel as an alternative to aluminum in the piston head would eliminate any potential secondary flash problems resulting from leakage in an aluminum piston head. Steel is lighter and cheaper than brass, and stronger and cheaper than aluminum, but steel is heavier than aluminum, so aluminum is the more desirable choice. Brass could also be used in the piston head, but brass is not at all necessary because the piston head does not need the elasticity required of conventional brass cartridge cases. It also may be possible that some types of plastic are suitable for use in the piston head. In any event, the firearm cartridges disclosed herein can be less expensive to manufacture than conventional cartridge cases in view of the choice of materials available and through the use of low cost manufacturing processes.

Figure 10:
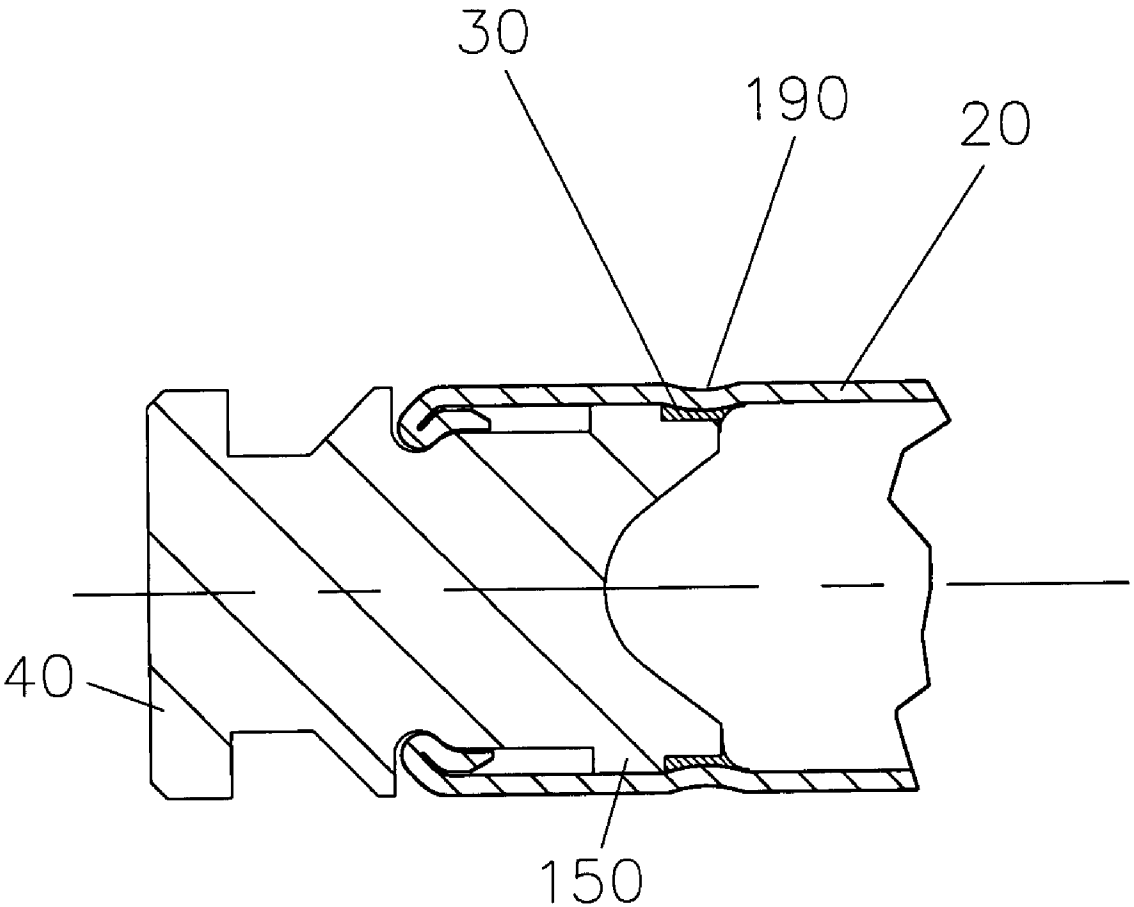
FIG. 10 is a sectional side view with a cannelure over the primer area.

Referring now to FIG. 10, cartridge case body 20 can be provided with a cannelure 190. Cannelure 190 provides a depression in cartridge case body 20 that extends therearound in a location aligned with priming composition 30. Cannelure 190 locates the annular priming impact area below the outer surface of cartridge case body 20 in order to reduce the exposure of the primer to accidental impact.

Figure 11:
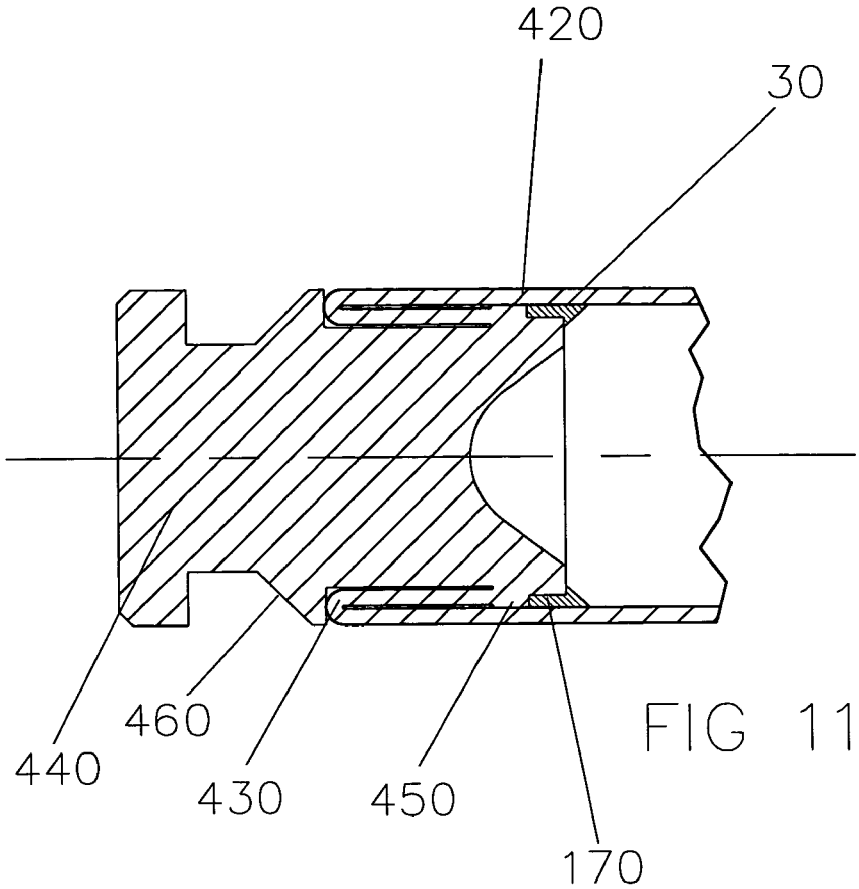
FIG. 11 is a sectional side view of a rearward portion of a second embodiment cartridge case.
Figure 12:
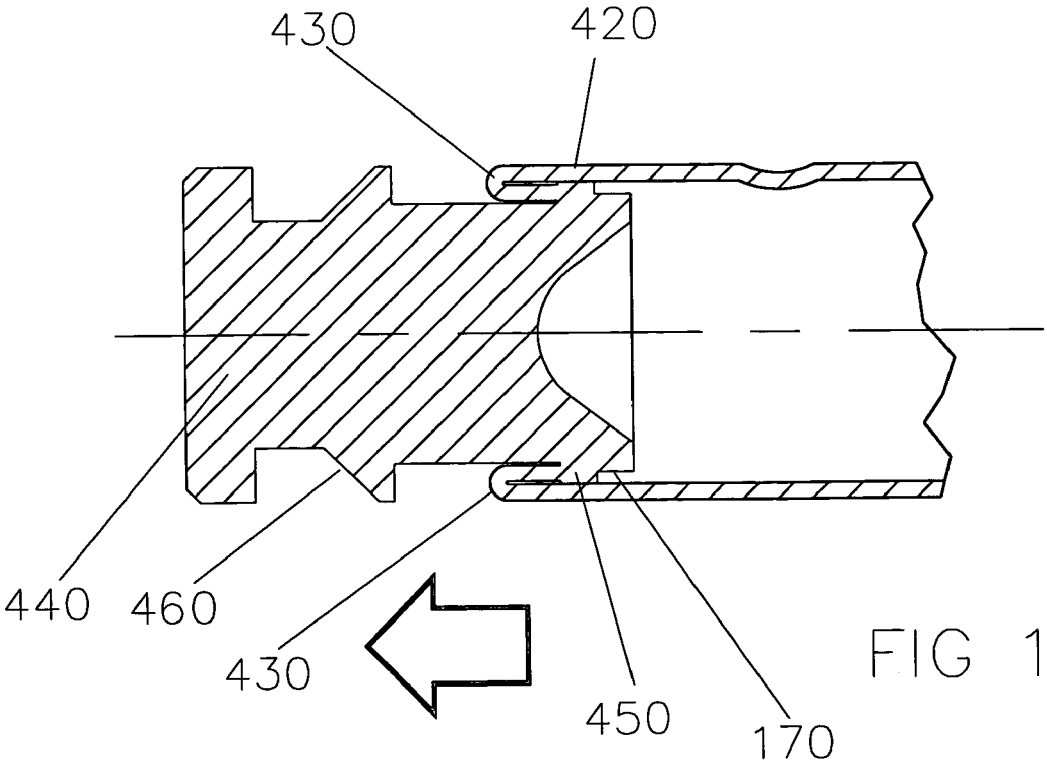
FIG. 12 is the cartridge case of FIG. 11 with the piston head extended.

Referring now to FIGS. 11 and 12, a second one piece embodiment piston head firearm cartridge is shown that is fabricated from a single piece of material. The one piece piston head 440 and one piece cartridge case body 420 are shown in FIG. 11 in an unfired condition, with priming composition 30 occupying forward groove 170 about one piece piston head 440. One piece head 440 is connected with one piece cartridge case body 420 with an integral fold portion 430 extending rearwardly from forward flange 450 of one piece piston head 440, and along one piece piston head 440 to intermediate flange 460. The integral fold portion 430 returns forwardly upon itself and along one piece piston head 440 to one piece case body 420. In FIG. 12, the cartridge is shown fired with one piece piston head 440 being retracted rearwardly relative to one piece cartridge case body 420. The integral fold portion 430 at the rearward end of one piece cartridge case body 420 is pulled rearwardly through plastic deformation, unfolding integral fold portion 430 as one piece cartridge case body 420 remains seized in the barrel chamber with internal pressure.

Figure 13:
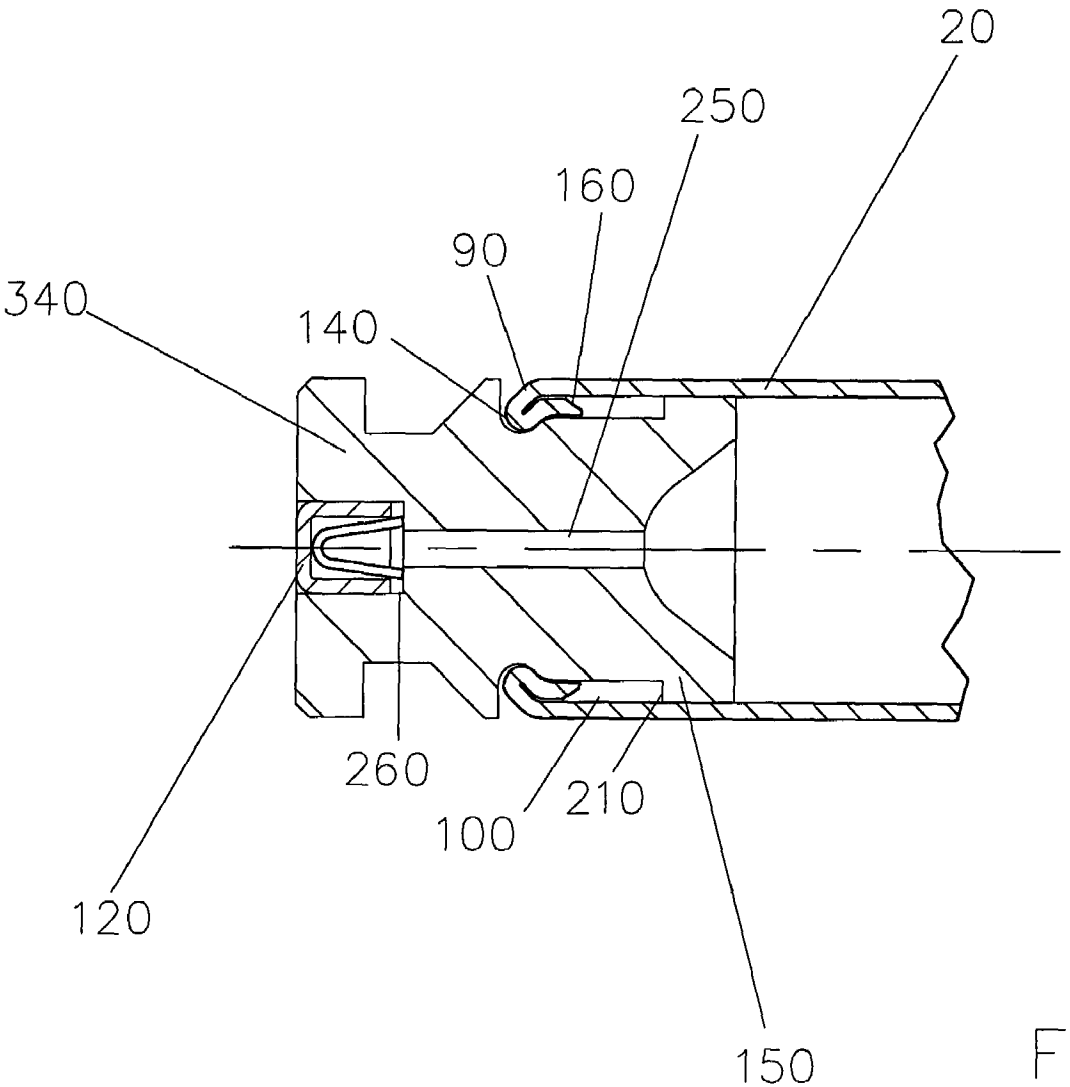
FIG. 13 is a sectional side view of a rearward portion of a third embodiment cartridge case.

Referring now to FIG. 13, there is shown another embodiment firearm cartridge that does not include a forward recess for a primer. The firearm cartridge in FIG. 13 employs a conventional Boxer type primer 120 with an alternate embodiment piston head 340. Alternate embodiment head 340 does not have a groove for receiving priming composition at the front or forward end of forward flange 150 since the primer is provided at the rearward end of alternate embodiment piston head 340. Alternate embodiment piston head 340 does include a central passage 250 extending between primer 120 and the hollow interior of cartridge case body 20 to permit the initiated primer composition of primer 120 to ignite propellant (not shown) in cartridge case body 20.

The embodiment of FIG. 13 cannot contain as high an operating pressure as the forward primer recess embodiments discussed above because, when fired, radial propellant pressure is applied to the primer pocket 260 receiving primer 120 at the rearward end of alternate embodiment piston head 340. Since primer pocket 260 is not radially supported by the barrel, the ability of this embodiment to contain pressure depends upon the hoop strength of alternate embodiment piston head 340. The smaller the diameter of the conventional type primer pocket, the greater strength of the piston head and the greater pressure the cartridge case can tolerate. Otherwise, the embodiment of FIG. 13 functions in the same way as the forward primer recess firearm cartridge embodiments discussed above.

Figure 14:
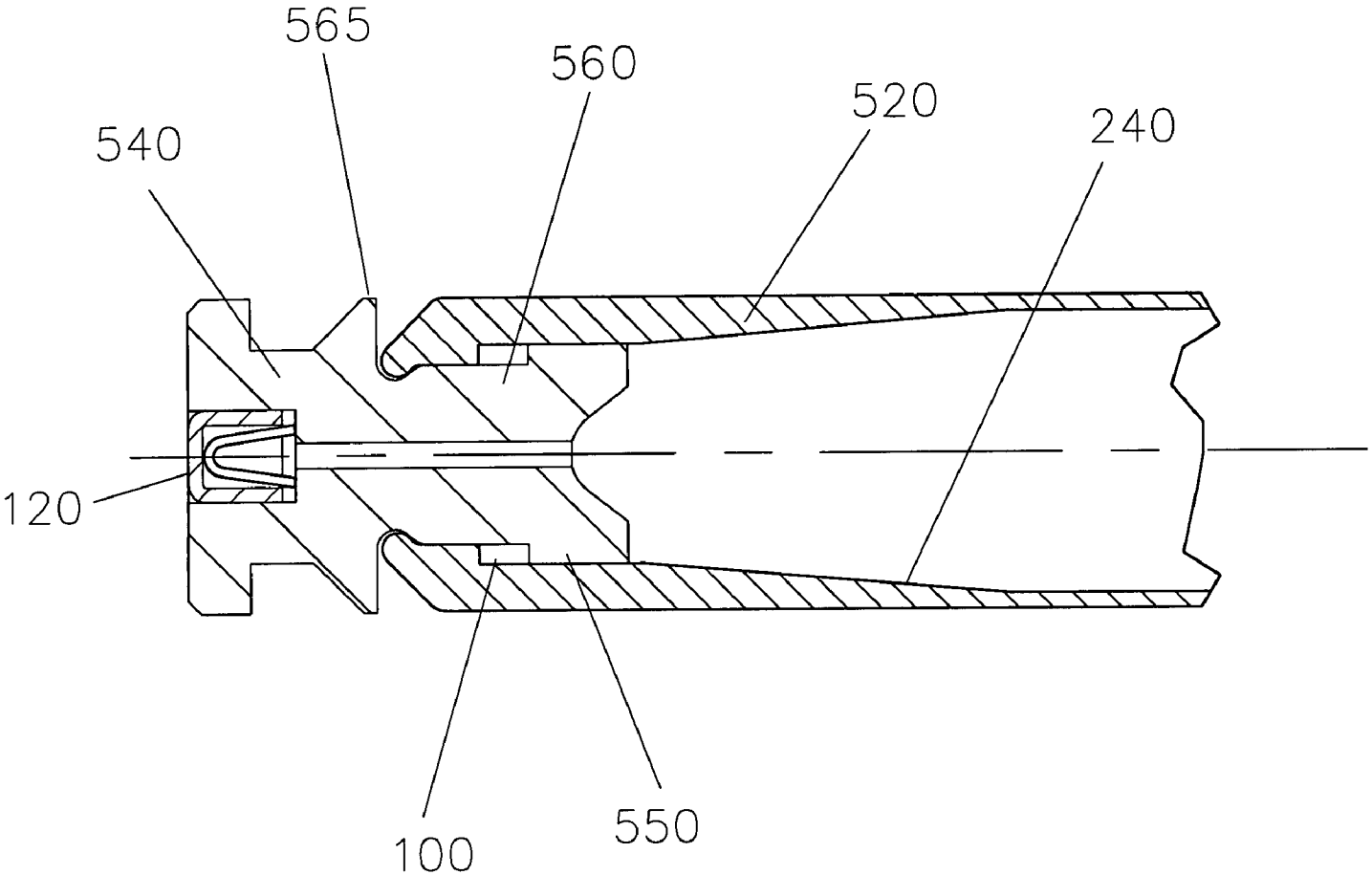
FIG. 14 is a sectional side view of the cartridge case of FIG. 13 in a further variation with a piston head having reduced effective pressure area.

Referring now to FIG. 14, there is shown a reduced inside diameter cartridge case body 520 with a reduced area piston head 540 having a reduced diameter extending forwardly from intermediate flange 565. Reduced area piston head 540 includes a neck 560 extending from intermediate flange 565 to reduced diameter forward flange 550. By reducing the piston head pressure area at the forward end of reduced area piston head 540, the rearward force applied to the bolt is reduced, thus permitting use of a lighter bolt for a given recoil velocity. To accommodate the reduced inside diameter of reduced internal diameter forward flange 550, reduced internal diameter cartridge case body 520 includes a tapered wall 240 on the interior of reduced internal diameter cartridge case body 520. The taper angle is designed such that the radial component of the vector of forces of firing pressure exceeds the rearward component so reduced internal diameter cartridge case body 520 will not move rearwardly in the chamber under firing pressure, even with the chamber lubricated. Gap 100 provides the same function as with the firearm cartridge embodiments discussed above employing a full diameter piston head.

The firearm cartridges discussed above can be employed in firearms where high pressure cartridges are desired; however, a locked breech for the firearm is unnecessary. The firearm cartridges discussed above permit the use of very high pressure cartridges in simple, blowback operated firearms. However, application in other weapon operating systems is not precluded, and even contemplated.

The firearm cartridges discussed herein can be employed to duplicate, for example, the external ballistics of the 5.56 mm M855 military cartridge in a blowback operated firearm. A fundamental equation in physics states that MV=MV, where M represents mass and V represents velocity. A 62 grain projectile with a 3,200 ft/sec muzzle velocity produces an (M)(V)=62 gr×3,200 fs=198,400 gr/ft/sec. One rule of thumb also adds 47% of the propellant charge weight to the projectile weight at the projectile velocity when calculating recoil. Using 15 grains as the charge weight and using 30 ft/sec as the desired blowback bolt velocity, then M(projectile) V(projectile)+(M(0.47×propellant)V(propellant))=M(bolt) V(bolt). Substituting the values in the equation results in (62)(3,200)+((15)(3,200)(0.47))=(X)(30). As a result, the mass of the bolt is determined to be X=7,365.3 grains. Converting to pounds, 7,365 grains/7,000 grains(per pound) =1.052 lb, which is the bolt weight required assuming that the pressure area of the piston head equals the pressure area of the base of the projectile. Accordingly, a one pound bolt in a blowback operated firearm delivering a conventional 62 grain projectile with a muzzle velocity of 3,200 feet per second is made possible by using the piston head cartridge discussed herein.

To date, blowback operation in light-weight firearms has not been possible with high pressure small arms cartridges because of prohibitive bolt weight and inadequate cartridge case strength. Blowback operation using very high pressure cartridges, however, is now made possible by providing a moveable piston head in the cartridge case body. The junction of the piston head with the wall of the cartridge case body can form a seal, before and/or during firing of the cartridge. The piston head is configured to permit the high pressure gas to expand the piston head to form a secure sliding seal with the wall of the cartridge case body. Simultaneously, the piston head is moveable rearwardly relative to the cartridge case with the system under full pressure.

The proliferation of interacting parts required to extract and store energy from firing, and for timing and harnessing the release of the stored energy for performing the steps in the cycle of functioning, is eliminated with the firearm cartridges discussed herein. Piston head cartridges permit very high pressure, high efficiency, high powered cartridges to be employed in simple blowback operated firearms, but with even lighter firearm parts than are practicable in locked operating systems. This weight reduction is made possible because many of the operating system parts required in a typical high pressure locked system are eliminated. For example, the weights of operating system reciprocating or recoiling parts of an M249 Light Machinegun are as follows:

| | |
|---|---|
| Operating Rod Assembly | .32 lbs |
| Bolt and slide Assembly | .51 lbs |
| Piston Group | .80 lbs |
| Total Recoiling Parts Wt. | 1.63 lbs |

In addition to the mass of the M249 recoiling parts, the M249 has the following non-reciprocating parts and associated weights in its operating system:

| | |
|---|---|
| Gas Cylinder Assembly Wt. | .33 lbs |
| Barrel Extension Est. Wt. | .25 lbs |
| Total Non-recoiling Parts Wt. | .58 lbs |
| Total weight of operating system parts | 2.21 lbs |

In an M249 Light Machinegun, 2.21 pounds of the total firearm weight is given to operating system parts. In a blowback operated machinegun using piston head cartridges to duplicate M855 external ballistics, and assuming a bolt velocity of 30 ft/s, the bolt would weigh about one pound, as determined above. If the pressure area of the piston head were made a smaller diameter than that of the projectile, then bolt weight could be reduced accordingly. However, if the kinetic energy of the bolt is to power a feed system, then a minimum bolt weight and velocity is required to provide adequate energy.

Regarding further potential weight reduction, since the mass of the bolt of a blowback operated firearm withstands the full force of firing, a high strength (heavy) receiver is not required to withstand the shock of firing as with a locked firearm. Receiver strength in a blowback firearm is designed mainly toward durability against rough handling by the user.

A straight blowback operated firearm does not require a dwell for the primary mass (bolt carrier) to travel a short distance known as "dwell" before picking up the secondary mass (bolt). Therefore the operating stroke length of a straight blowback operated firearm for a given cartridge length is inherently shorter than in a primary/secondary mass firearm. The elimination of dwell also permits designing a firearm with a higher cyclic rate for a given cartridge length and given initial recoiling mass velocity compared to firearms requiring a dwell and a secondary mass. In a blowback operated firearm, there is also no loss in recoiling parts velocity due to momentum transfer at secondary mass pick up, so a higher cyclic rate is also made possible because a higher average velocity of recoiling parts can be maintained for a given initial velocity. An indirect benefit of the blowback system when employed in a machinegun is that no direct shock of firing is transmitted to the firearm to disturb round control during feeding. The round is already fed when the bolt reaches the buffer. The firearm cartridges discussed herein permit blowback operation with any firing pressure which the barrel can support.

When used with priming composition placed about the forward end groove of the piston head, the piston head can be made as a solid plug capable of withstanding greater pressures than conventionally primed cartridge cases. The primer is completely eliminated as a separate assembly, and the priming composition is contained in an annular recess fully formed by assembly of the cartridge case body with the piston head. No special parts, such as a primer cup or anvil, are required to provide priming.

The firearm cartridges with the forward primer recess can be primed using the same simple and inexpensive techniques employed in priming rimfire ammunition. Placing the priming composition into its recess while it is in a wet condition means that the priming composition will be in intimate molecular contact when dried, with both the cartridge case body and the piston head. There is no potential deformation or breakage of a primer pellet during primer seating as can happen with conventional primers. Deformation of conventional primer pellets in seating of the primer can result in cracking of the pellet because the priming composition is usually already dried and is relatively brittle. Damaged primer pellets in conventional primers increases the probability of hang fires and misfires, as well as contributing to a reduction in accuracy. With the forward primer recess firearm cartridges, there is no possibility of inverting the primer as can happen when seating conventional primers. The forward primer recess firearm cartridges also eliminates the potential explosion hazard posed by the storage and transportation of large quantities of conventional primers. A large quantity of forward primer recess firearm cartridges could be accidentally dropped on a hard surface without danger of a large explosion even if a few of the primers were initiated.

A further benefit of the forward primer recess firearm cartridge is that the interference fit of a precision primer assembly with a precision primer pocket is eliminated. Tolerances for diameters of primer pockets are typically less than 0.001 inch. Primer pocket depth tolerances are not as tight, but the overall length of the primer assembly has a dimensional tolerance and the seating depth of the primer assembly in the primer pocket has a dimensional tolerance. The build up of the tolerances involved in seating conventional primer assemblies means there is a relatively large range of seating conditions possible for the primer assembly in loaded conventional cartridges. Primer output fluctuates according to the compression and condition of the primer pellet, which affects reliability as well as accuracy. The forward primer recess cartridges discussed herein permit placing the priming composition in a wet condition into its loaded position and letting it dry in place, contributing to improved reliability and accuracy.

The forward primer recess piston head firearm cartridges disclosed herein eliminate gas leakage into the breech of the firearm, as is common with conventionally primed cartridges. Furthermore, since the piston head functions as the primer anvil, the separate anvil of conventional Boxer primers is eliminated. Forward recess priming will significantly reduce the cost of producing ammunition because the following components can be eliminated: the primer cup; the primer anvil; the primer over-pellet paper; the primer pocket in the cartridge case; and the primer flash hole in the cartridge case.

The piston head firearm cartridges disclosed herein are less sensitive to both excessive and insufficient headspace between the bolt face and rearward face of the fully chambered piston head cartridge. If there is excessive headspace at firing, there will be no rupture of the cartridge case, but primer initiation will seat the piston head against the bolt face before full pressure comes on, and the firearm will function normally. If there is insufficient headspace, then the rear of the cartridge case body can crush or fold at its junction with the piston head, and the firearm will function normally.

While the invention has been illustrated and described in detail in the drawings and foregoing description, the same is to be considered as illustrative and not restrictive in character, and that all changes and modifications that come within the spirit of the invention are desired to be protected.

What is claimed is:

1. A firearm cartridge, comprising:

a case body including a wall extending between a forward end and a rearward end, said case body wall defining a hollow interior and propellant in said hollow interior; and a piston head including a forward end positioned in said hollow interior adjacent said rearward end of said case body and with propellant forwardly of said forward end of said piston head and further comprising priming composition in a recess between an outer surface of said piston head and said wall of said case body, said piston head being rearwardly movable relative to said case body via pressure from firing the firearm cartridge.

2. The cartridge of claim 1, wherein said piston head is fixedly engaged to said rearward end of said case body, and when the firearm cartridge is fired said piston head is disengaged from said case body for movement rearwardly relative thereto in sealing engagement with said wall of said case body.

3. The cartridge of claim 1, wherein said rearward end of said case body includes a fold portion crimpable to engage said piston head.

4. The cartridge of claim 3, wherein said piston head includes a groove extending thereabout, said groove being located between a forward end and a rearward end of said piston head, said fold portion being crimpable into said groove.

5. The cartridge of claim 4, wherein said piston head includes an intermediate flange extending radially about a rearward side of said groove.

6. The cartridge of claim 1, wherein said piston head includes a flange in said hollow interior spaced rearwardly of said forward end of said piston head, said piston head further including a groove extending forwardly of said flange to said forward end of said piston head.

7. The cartridge of claim 6, wherein said groove forms said recess along said wall of said case body.

8. The cartridge of claim 1, wherein said forward end of said piston head includes a concave recess in communication with propellant in said case body.

9. The cartridge of claim 8, wherein said concave recess receives pressure from the firearm cartridge when fired and is structured to radially expand said piston head in slideably sealing engagement with said case body.

10. The cartridge of claim 1, wherein said piston head is integrally formed with said case body.

11. The cartridge of claim 1, wherein said piston head includes a flange in said hollow interior spaced rearwardly of said forward end of said piston head, said piston head further including a grooved portion extending rearwardly from said flange, said grooved portion receiving a rearward end of said case body.

12. The cartridge of claim 11, wherein said rearward end of said case body includes a shoulder engaged to said piston head in said grooved portion, and further comprising a gap formed by said piston head and said wall of said case body, said gap extending between said shoulder and said flange.

13. The cartridge of claim 12, wherein said gap accommodates rearward movement of said piston head relative to said case body when the firearm cartridge is fired.

14. The cartridge of claim 12, wherein said shoulder of said case body is formed by inwardly folding said wall of said case body at said rearward end of said case body, thereby forming a space between said shoulder and said wall of said case body.

15. The cartridge of claim 12, wherein said shoulder includes a forwardly oriented chamfered end wall.

16. A firearm cartridge, comprising:

a case body including a wall extending between a forward end and a rearward end, said case body wall defining a hollow interior; and a piston head including a forward end positioned in said hollow interior adjacent said rearward end of said case body in said hollow interior, said piston head including a flange extending therearound engageable with said wall of said case body, said piston head further including a groove extending forwardly of said flange, said groove and said wall of said case body defining a recess; and priming composition in said recess.

17. The cartridge of claim 16, wherein said piston head is rearwardly movable relative to said case body when the firearm cartridge is fired.

18. The cartridge of claim 16, wherein said piston head is fixedly engaged to said rearward end of said case body, and when the firearm cartridge is fired said piston head is unfixed from said case body for movement rearwardly relative thereto in sliding engagement therewith.

19. The cartridge of claim 16, wherein said rearward end of said case body includes a fold portion engaged to said piston head.

20. The cartridge of claim 19, wherein said piston head includes an intermediate groove extending thereabout, said intermediate groove being located between a forward end and a rearward end of said piston head, said fold portion being engaged in said intermediate groove.

21. The cartridge of claim 16, wherein said forward end of said piston head includes a concave recess in communication with propellant in said case body.

22. The cartridge of claim 21, wherein said recess receives pressure from the firearm cartridge when fired and is structured to radially expand said flange of said piston head in sealing engagement with said case body.

23. The cartridge of claim 16, wherein said piston head is integrally formed with said case body.

24. The cartridge of claim 16, wherein said piston head includes a grooved portion extending rearwardly from said flange, said grooved portion receiving a rearward end of said case body.

25. The cartridge of claim 16, wherein said rearward end of said case body includes a forwardly facing shoulder engaged along said piston head, and further comprising a gap formed by said piston head and said wall of said case body, said gap extending between said shoulder and a rearward face of said flange.

26. The cartridge of claim 25, wherein said gap accommodates rearward movement of said piston head relative to said case body when the firearm cartridge is fired.

27. A firearm cartridge, comprising:

a case body including a wall extending between a forward end and a rearward end, said case body wall defining a hollow interior for receiving propellant; and a piston head including a forward end positioned in said hollow interior adjacent said rearward end of said case body, said piston head including a flange extending thereabout and a forwardly opening recess in said forward end in communication with said hollow interior, said piston head being expandable by pressure in said recess created upon firing of the cartridge to seal said flange against an inner surface of said wall of said case body.

28. The cartridge of claim 27, wherein said piston head is rearwardly movable relative to said case body when the firearm cartridge is fired.

29. The cartridge of claim 27, wherein said piston head includes a groove extending forwardly of said flange, said groove forming a second recess with said wall of said case body opening forwardly into said hollow interior, and further comprising a priming composition in said second recess.

30. The cartridge of claim 29, wherein said wall of said case body includes groove in an outer surface thereof aligned with said second recess.

31. The cartridge of claim 27, wherein said recess is concavely curved.

32. The cartridge of claim 27, wherein said rearward end of said case body includes a fold portion, said fold portion including an inner wall member extending along said wall of said case body, said inner wall member including a forwardly facing shoulder.

33. The cartridge of claim 32, wherein said inner wall member forms a space along said wall of said case body.

34. The cartridge of claim 33, wherein said forwardly facing shoulder includes a chamfer.

35. The cartridge of claim 32, further comprising a gap between said forwardly facing shoulder of said case body and a rearwardly facing shoulder of said flange of said piston head, said gap accommodating rearward movement of said piston head relative to said case body upon firing of the firearm cartridge.

36. The cartridge of claim 35, wherein said piston head is rearwardly movable to engage said rearwardly facing shoulder of said flange with said forwardly facing shoulder of said case body and plastically deform said fold portion.

37. The cartridge of claim 27, wherein said piston head includes a primer assembly embedded in a rearwardly oriented face thereof, said piston head further comprising a passage extending therethrough between said primer assembly and said hollow interior of said casing.

38. The cartridge of claim 27, wherein said piston head is integrally formed with said case body.

39. The cartridge of claim 38, wherein said case body includes a fold portion at a rearward end thereof, said fold portion including an inner member extending from said rearward end and forwardly along said wall to said flange of said piston head, said inner member being integrally formed with said flange.

* * * * *